US005219246A

United States Patent [19]

Coutts et al.

[11] Patent Number: 5,219,246

[45] Date of Patent: Jun. 15, 1993

[54] DRILLS FOR PILES AND SOIL STABILIZATION, AND DRILLING METHOD

[75] Inventors: Peter G. Coutts; Robin McQueen, both of Northgate, Australia

[73] Assignee: Catawa Pty. Ltd., Australia

[21] Appl. No.: 750,410

[22] Filed: Apr. 22, 1991

[30] Foreign Application Priority Data

Aug. 29, 1988 [AU] Australia ..... PJ0089
Sep. 2, 1988 [AU] Australia ..... PJ0215

[51] Int. Cl.[5] ..... E02D 5/36; E21B 10/32

[52] U.S. Cl. ..... 405/237; 475/292; 405/240

[58] Field of Search ..... 405/233, 237, 240, 241, 405/1; 175/263, 265, 279, 286, 290, 292; 82/1.5; 408/187, 188

[56] References Cited

U.S. PATENT DOCUMENTS 1,371,425 3/1921 Jones ..... 175/287
2,990,896 7/1961 Kandle ..... 175/292
4,100,750 7/1978 Labrue ..... 405/241

FOREIGN PATENT DOCUMENTS 251300 8/1963 Australia .
47563/79 12/1979 Australia .
2422489 11/1975 Fed. Rep. of Germany .
2709030 8/1978 Fed. Rep. of Germany .
36592 3/1980 Japan ..... 405/241
33641 2/1983 Japan ..... 405/240
162628 7/1986 Japan ..... 405/237
90/02243 3/1990 World Int. Prop. O. .

*Primary Examiner*—David J. Bagnell
*Attorney, Agent, or Firm*—Larson and Taylor

[57] ABSTRACT

A drilling assembly (210) for in-situ cast piles has a drill stem (211) with a helical flyte (212). A drilling head (224), with teeth (225), and a belling tool (226), with retractable cutting tools (227) are mounted on, in driving engagement with, the non-circular shank (218) of a soil stabilization spear (214). The spear (214) drills a pilot hole in advance of the drilling head (224) and grout pumped down through the tubular body (215) of the spear (214) fills the cracks and fissures in the surrounding soil to stabilize the soil as the drilling assembly (210) is advanced. When the desired depth is reached, the rotation of the drilling assembly (210) is reversed and cutting tools (227) are extended to cut a "bell" or annular chamber around the hole. As the drill assembly (210) is withdrawn from the hole, grout pumped down the interior (230) of the stem (211) fills the hole to cast a pile in-situ, the increased diameter of the bottom of the pile, and the stabilized soil around it, increasing its load strength.

8 Claims, 6 Drawing Sheets

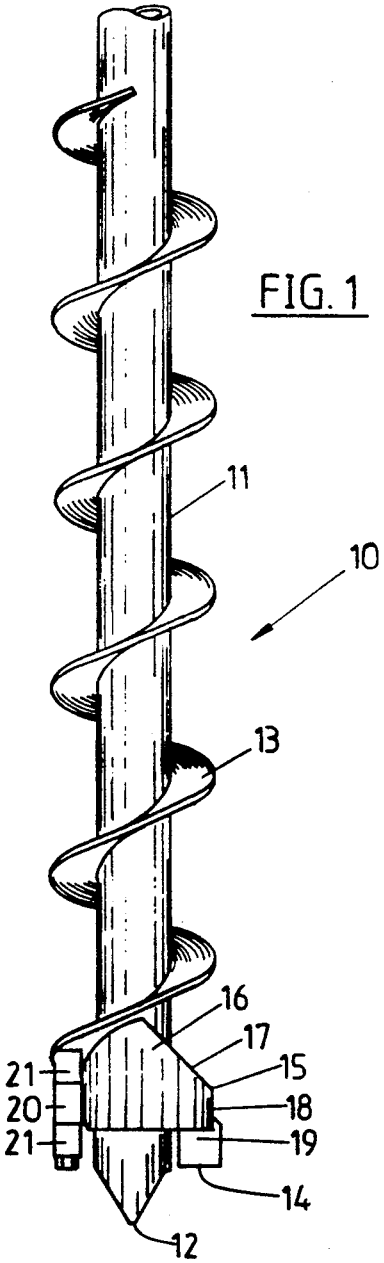
FIG. 1
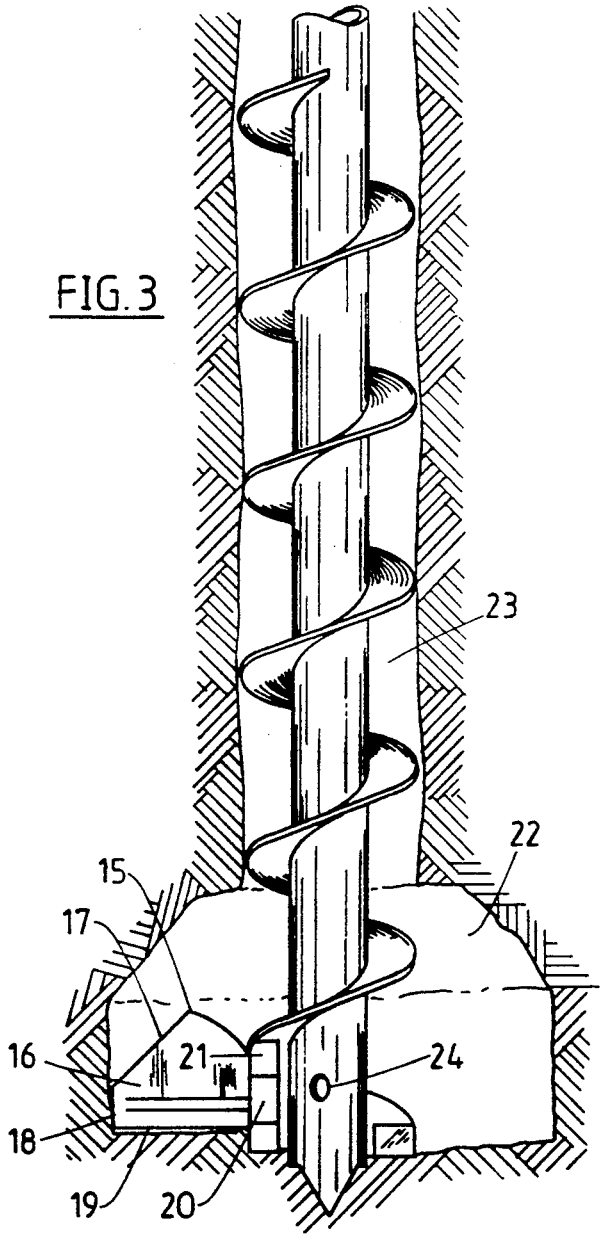
FIG. 3
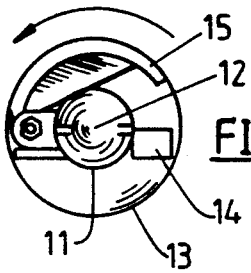
FIG. 2
FIG. 4
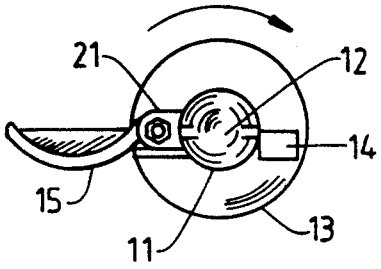

DRILLS FOR PILES AND SOIL STABILIZATION, AND DRILLING METHOD

BACKGROUND OF THE INVENTION

1. Field of the Invention

THIS INVENTION relates to improvements in drills for piles. The term "piles" shall be used to include in-situ cast piles; tension piles; rock bolts; and ground-or-sand anchors.

The invention also relates to improvements in drills for soil stabilization.

2. Prior Art

On many building sites, compression piles having diameters of at least 300 mm are either driven into the ground, or cast in-situ, to provide sufficient bearing load for the building foundation. The drills required for the holes for the cast piles must be mounted on large prime-movers, which are expensive, and their access can be limited on the sites.

The load strength of the foundation piles used in buildings and civil engineering works is also dependent on the properties of the soil surrounding the piles. If the soil has a composition which includes e.g. clay or sand, or is full of fissures or cracks, the load strength of the piles will be much lower than if they were supported by rock.

SUMMARY OF THE INVENTION

It is an object of the present invention to provide a means for increasing the effective diameters, and thereby the load capacities, of the piles.

It is a preferred object of the present invention to provide a drill for improved in-situ cast piles which can have the same bearing load as conventional piles within a generally smaller diameter hole.

It is a preferred object to provide drills for drilling the holes for such piles which enables smaller equipment to be used.

It is another preferred object to provide drills where a number of "bells" or enlarged portions can be formed down the piles to form an effective tapered shear column.

It is a still further preferred object of the present invention to prestabilize the soil before the piles are cast (or driven down a pilot hole).

It is a still further preferred object to provide the apparatus to prestabilize the soil on the drilling equipment for the pile holes.

Other preferred objects of the present invention will become apparent from the following description.

In one aspect the present invention resides in a drill for drilling holes for in-situ cast piles including:

a stem connectable to a drilling machine and having a drilling point at one end;

a helical flyte or spiral around or within the stem; and at least one cutting tool hingedly mounted on the stem, the or each cutting tool normally occupying a retracted position adjacent the stem when the stem is rotated in the drilling direction of the helical flyte or spiral but movable to an extended position to cut a respective substantially annular chamber around the hole when the stem is rotated.

The cutting tool may be movable to the extended position by rotating the stem in the reverse direction and then retracted by rotating the stem in the drilling direction. Alternatively, mechanical means e.g. cam or rachet means may be provided which allow the cutting tool to be extended when the rotation direction of the stem is reversed and locked in the extended position when the stem is rotated int he drilling direction, and then released and retracted when the stem rotation direction is again reversed.

The stem may comprise a drilling rod, auger or casing. Preferably the stem is hollow to allow the passage of drilling fluid, chemicals, air, foam and/or grout down through the stem and into the hole and/or the chamber formed by the drill assembly.

A plurality of the cutting tools may be provided along the length of the stem to enable a plurality of "bells" to be formed which enable a tapered shear column to be cast in-situ.

Preferably the or each cutting tool has a downwardly inclined top face so that the top of the annular chamber is upwardly convergent.

In a second aspect the present invention resides in a "belling" tool for piles including:

a housing, substantially circular in plan view;

a central bore through the housing to receive the stem of the drill in rotational driving engagement;

at least one cavity in the periphery of the housing; and a cutting tool hingedly mounted in the or each cavity, the or each cutter tool normally occupying a retracted position with its cavity when the drill is rotated in its drilling direction but movable to an extended position to cut a respective substantially annular chamber around the hole formed by the drill when the drill is rotated in the opposite direction.

In a third aspect the present invention resides in a drill for piles including:

a central stem;

a drilling point or tool at the lower end of the stem;

a helical flyte around the stem; and a belling tool as hereinbefore described interposed between the drilling point or tool and the lower end of the helical flyte.

While the housing may be fixed to the stem of the drill, it is preferred that it be releasably secured by the shank on the drilling point or tool received in the lower end of the stem, the central bore preferably being non-circular.

Preferably there are two cutting tools provided on the belling tool and it is preferred that they be vertically offset and diametrically opposed. Preferably each cutting tool is curved in plan view and preferably a series of teeth are provided about the outer periphery. Preferably each tooth has a hardened face. Preferably each cutting tool has a back tooth which cuts a greater diameter than the drilling point or tool.

In a fourth aspect the present invention resides in a method for prestabilizing soil for piling including the steps of:

attaching a drilling spear to a drill assembly for a piling hole;

driving the spear into the soil to a depth at which the soil is to be stabilized;

injecting grout under high pressure into the soil around the spear to at least partially fill the cracks and/or fissures in the soil around the spear;

advancing the spear to a lower depth while the drill assembly drills through the grouted soil; and repeating the injection and advancing steps until the soil is stabilized to the desired depth.

In a fifth aspect the present invention resides in a drilling spear for prestabilizing soil for piling including:

a tubular body having a central grout passage;

mounting means at one end to enable attachment of the spear to the drilling end of a drilling assembly;

soil cutting means at or adjacent the other end of the spear to enable it to drill a hole through the soil as it is rotated with the drilling assembly; and a plurality of grout ports through the wall of the tubular body connected to the group passage;

so arranged that when the spear reaches a predetermined depth, grout under pressure is pumped through the grout ports into the soil around the spear to at least partially fill the cracks and/or fissures in the soil around the spear.

The spear preferably has a tubular body which, at its upper end, has a hollow shank receivable in the lower end of the stem of the drill assembly, a drilling head being preferably mounted on, in driving engagement with, the shank. A belling tool, interposed between the drilling head and the helical flyte of the drilling assembly, may also be mounted on, in driving engagement with the shank.

The tubular body may be terminated by a central drilling point and by one or more cutting teeth. Additional cutting teeth may be provided intermediate the length of the body.

Preferably the grout ports are provided at equidistant spacings along the spear.

BRIEF DESCRIPTION OF THE DRAWINGS

To enable the invention to be fully understood, a number of preferred embodiments will now be described with reference to the accompanying drawings, in which:

FIG. 1 is a side view of the drill assembly of a first embodiment;

FIG. 2 is a bottom view of the drill assembly with the cutting tool retracted;

FIG. 3 is a side view of the drill assembly drilling a hole for an in-situ cast pile;

FIG. 4 is a bottom view of the drill assembly with the cutting tool extended;

DETAILED DESCRIPTION OF THE PREFERRED EMBODIMENTS

Figure 5:
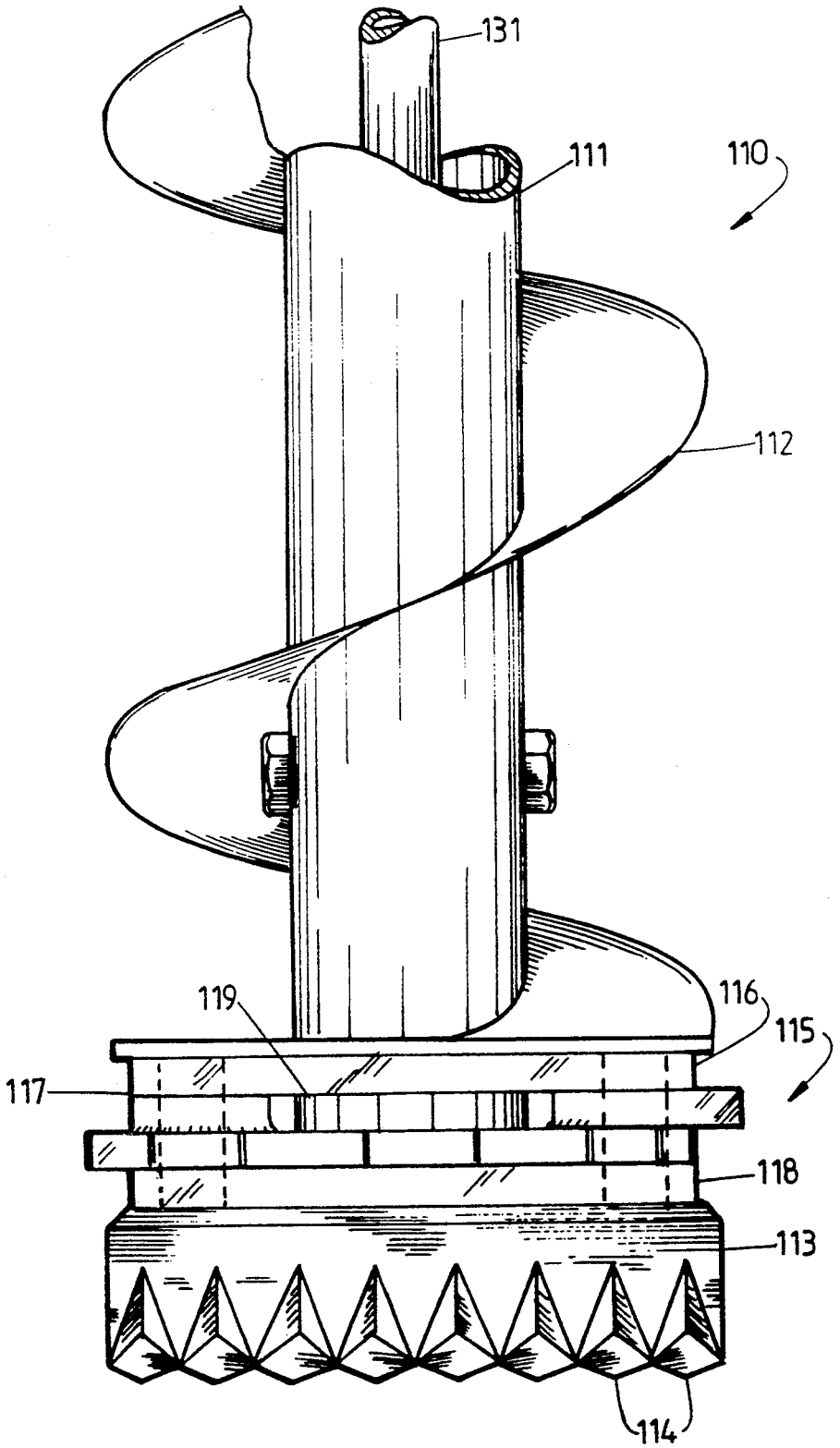
FIG. 5 is a side view of a drill fitted with a removable belling tool in accordance with a second embodiment of the present invention.

Referring to FIGS. 1 and 2, the drill assembly 10 has a tubular stem 11 with a tapered drilling tip 12. A helical flyte 13 around the stem has a cutting edge 14 with cutting teeth (not shown).

The cutting tool 15 has a body 16 which is curved in plan. The body has a downwardly inclined top face 17, a vertical side face 18 and horizontal bottom face 19. A tubular lug 20 is formed on the inner end of the body 16 and receives a bolt fixed in a pair of blocks 21 welded on the flyte 13 and stem 11.

In use, the drill assembly is rotated in its drilling direction and the drill reverberates the ground, the loosened soil being lifted by the helical flyte 13. Drilling chemicals and/or air may be pumped down the stem 11 to assist in lifting the soil.

When the drill reaches the desired depth, its direction of rotation is reversed. The cutting tool catches on the side of the hole and is caused to swing out to the extended position shown in FIG. 4. As the drill continues to rotate, the cutting tool cuts out a bell-shaped chamber 22 around the hole 23. Cementitious grout is pumped down the stem 11 through the hole 24 and is distributed within the chamber 22 by the cutting tool. The drill assembly is then raised until the chamber 22 is of the desired height (see FIG. 3).

The rotation of the drill is then reversed to its original drilling direction and the cutting tool 15 is retracted.

Grout is continuously pumped through the stem as the drill is withdrawn so that the hole is filled with the grout which then sets as the in-situ cast pile. (As the top of the chamber is upwardly convergent, the mud in the chamber 22 is forced up into the hole 23, ensuring the integrity of the chamber or "bell".

With the drill assembly 10, it is possible to drill a hole of e.g. 200 mm diameter when the chamber is of e.g. 400 mm diameter, providing the necessary bearing area for the foundations. However, such a drill can be manhandled and operated on a light portable drilling machine without the need for a large prime mover or drilling machine. In addition, the tapered conical top to the foot of the pipe, formed by the top of the chamber 22, resists any upward hydrostatic pressure which may be applied to the pile.

In a modified form of the drill assembly, not shown, the cutting tool 15 is releasably retained in the retracted position by a cam or rachet mechanism on the drill stem 11. When the rotation of the stem is reversed, the cutting tool 15 is released and swings outwardly on engagement with the side of the hole. When the cutting tool is fully extended, the cam or rachet mechanism locks the cutting tool in that position and the stem is then rotated in the drilling direction to cause the cutting tool to cut the annular chamber 22.

To enable the drilling assembly to be withdrawn from the hole, the rotation direction of the stem is again reversed. This causes the cam or rachet mechanism to release the cutting tool and it moves back to its retracted position to enable the drill assembly to be withdrawn from the hole.

While the hold and chamber are being formed by the drill assembly, and prior to the pumping of the cementitious grout down the stem, air and/or foam may be pumped down the stem to support the roof of the chamber and to flush the hole.

In conventional piling drills, rubbish can enter the stem 11 in the hole 24 preventing or restricting the flow of chemicals and/or grout. As the cutting tool 15 covers the hole as the drill penetrates the soil, the hole 24 cannot become blocked, which is another advantage of the present invention.

Figure 6:
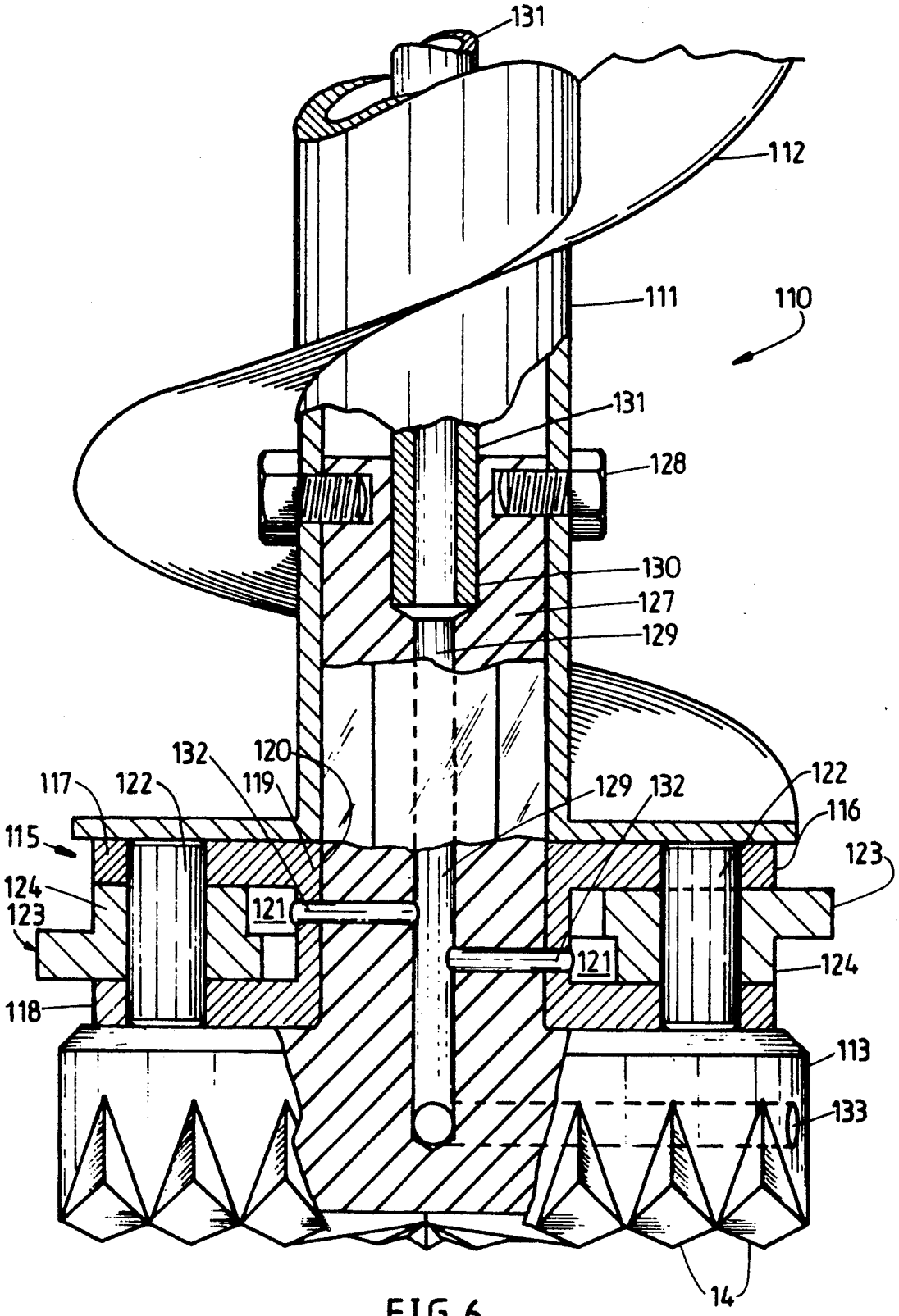
FIG. 6 is a part-sectional side view corresponding to FIG. 5.

Referring to FIGS. 5 and 6, a drill 110 has a hollow stem 111 surrounded by a helical flyte 112. A drilling head 113, with hardened teeth 114, is fitted to the lower end of the stem 111. As shown, the belling tool 115 is interposed between the lower end of the helical flyte 112 and the drilling head 113.

The belling tool 115 has a housing 116 which is generally circular in plan view and ha a pair of annular plates 117, 118 interconnected by a hub 119 which has a hexagonal central bore 120.

A cavity 121 extends circumferentially around the housing, defined by the annular plates 117, 118 and the hub 119.

A pair of diametrically opposed hinge pins 122 are fixed in the annular plates 117, 118, and a cutting tool 123 is hingedly mounted on each. As shown in FIG. 5, each tooth is of a thickness substantially equal to one-half the height of the cavity and the teeth have laterally extending cheeks 124 journalled on the pivot pins 22 to enable the cutting tools 123 to be vertically offset.

Figure 7:
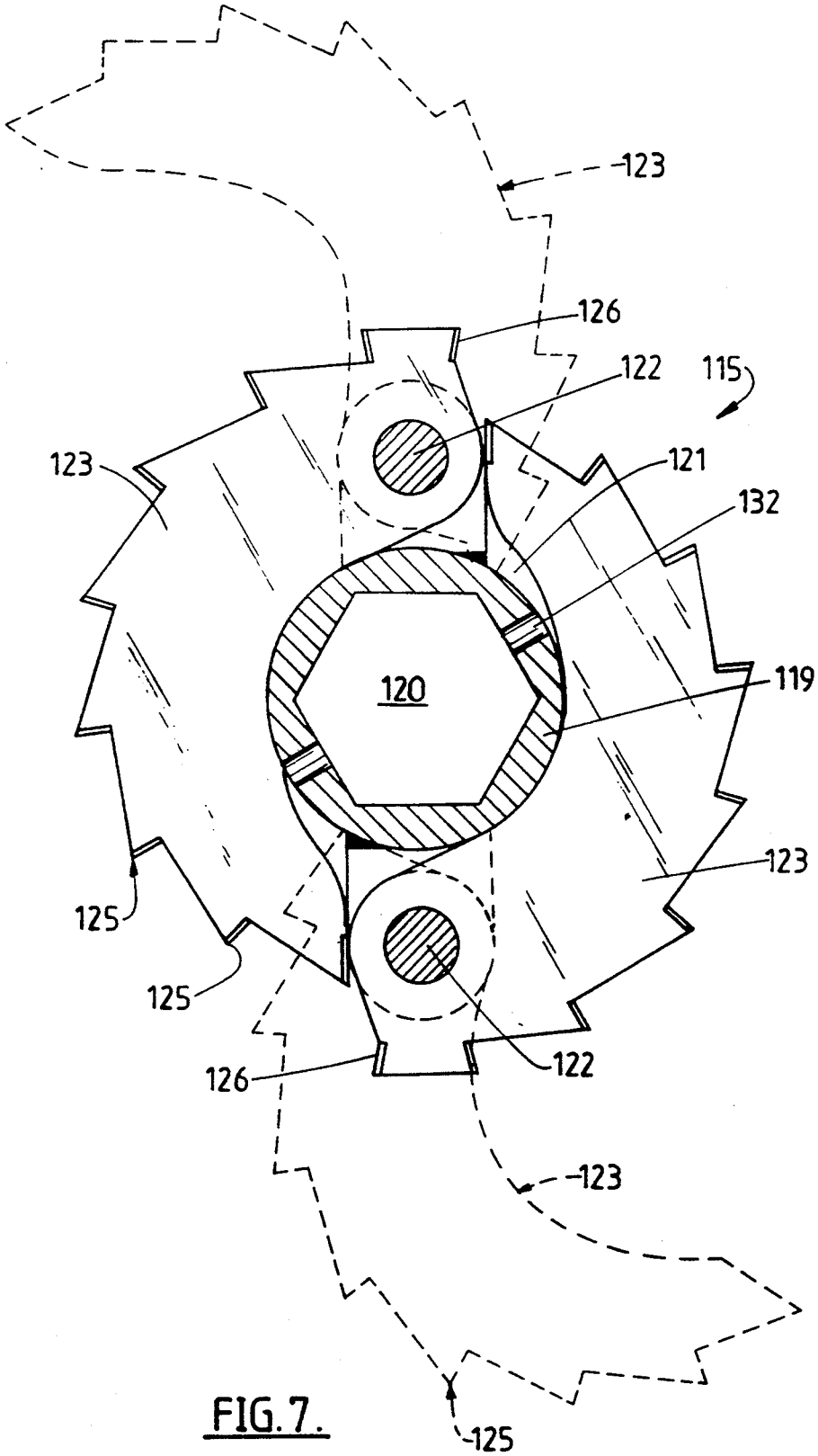
FIG. 7 is a sectional top view of the belling tool showing the cutting teeth in the retracted position (solid lines) and extended position (dashed lines)

As shown in FIG. 7, each cutting tool 123 is curved in plan view and has a plurality of teeth 125, each with hardened cutting edges, about its outer periphery. A back tooth 126 is provided on each cutting tool 123 adjacent its pivot pin 122.

The belling tool 123 is secured to the drill stem 111 by the shank 127 of the drilling head 113, the shank being locked in the stem by studs 128.

A bore 129 through the shank 128 has an enlarged upper section 130 which receives the lower end of a grout pipe 131 coaxial with the stem 111.

Branch passages 132 pass through the shank 127 and hub 119 to the cavity 121 and a branch passage 133 extends to the periphery of the drilling head 113.

In use, the belling tool 115 is fitted to the drill 10 between the helical flyte 112 and drilling head 113 as shown in FIG. 5 and 6, the cutting tools 123 being retracted as shown in solid lines in FIG. 7.

As the drill is rotated, the drilling head 113 cuts through the soil and the diameter of the hole is enlarged by the slightly overside back teeth 126 on the belling tool 115. The soil which has been loosened is raised up the hole by the helical flyte 112.

When the desired depth of the hole is reached, the operator reverses the direction of the drill. One or more of the teeth 125 on the cutting tools 123 engage the adjacent side wall of the hole and cause the cutting tools to be extended as shown in dashed lines in FIG. 7. A small amount of grout may be pumped down the grout pipe 131 and out the branch passages 132 to assist in moving the cutting tools towards their extended positions.

As the belling tool 115 is rotated, the cutting tools 123 cut an annular chamber about the hole and by raising the drill 110, the depth of the chamber can be increased until, preferably, its height equals its diameter. When the annular chamber or "bell" has been formed, the rotation of the drill 110 is then reversed to its original drilling direction and the cutting tools 123 are retracted. Grout is continuously pumped down through the grout pipe 131 and out the branch passages 132, 133 as the drill 110 is withdrawn so that the hole (and the annular chamber or "bell") is filled with the grout which sets as the in-situ cast pile.

With the belling tool 115, it is possible to drill a hole of e.g. 200 mm diameter with the drill 110 and then form the chamber e.g. 400 mm diameter, providing the necessary bearing area for the foundations. However, the a drill can be manhandled and operated on a light portable drilling machine without the need for a large prime mover or drilling machine.

While the hole and chamber are being formed by the drill, and prior to the pumping of the cementitious grout down the grout pipe 131, air and/or foam may be pumped down the stem 111 to support the roof of the chamber and to flush the hole.

It is possible to use the present invention to produce a tapered shear column. Chambers of reducing diameters are formed about the hole using a number of interconnected rill assemblies, each having a belling tool 115 of the type described. The diameter of, and distance between, the chambers will be selected so that the shear strength between the respective "wedges" formed around the pile in each chamber is substantially equal to the shear strength of the pile. The wedges create friction between the pile and the surrounding soil, so that the pile is not relying solely on the friction between the wall of the pile and the surrounding soil.

Figure 8:
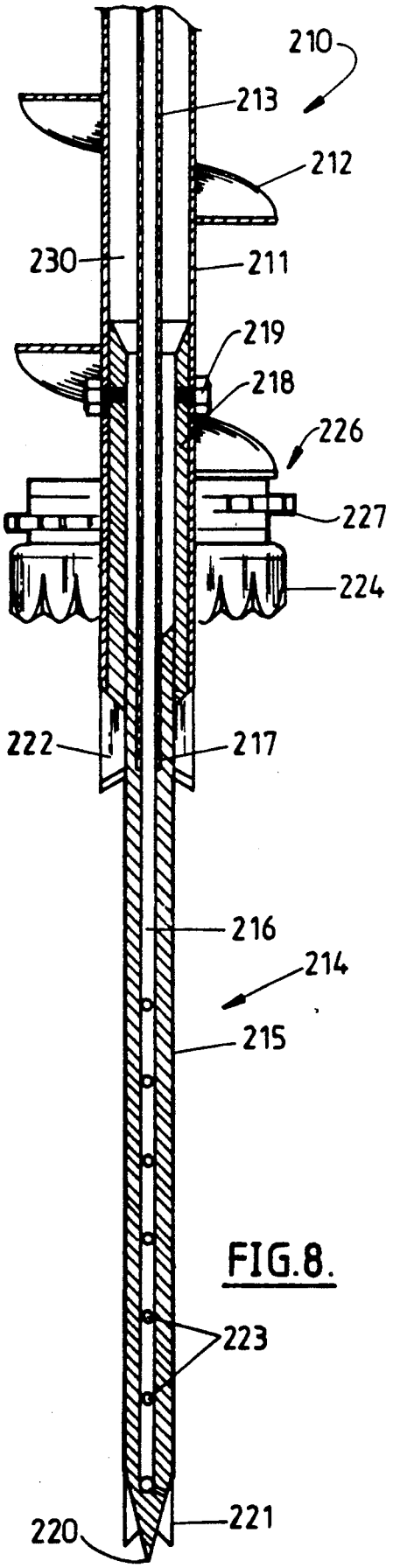
FIG. 8 is a sectional side view showing a spear of a third embodiment fitted to a piling drill which has a belling tool.
Figure 9:
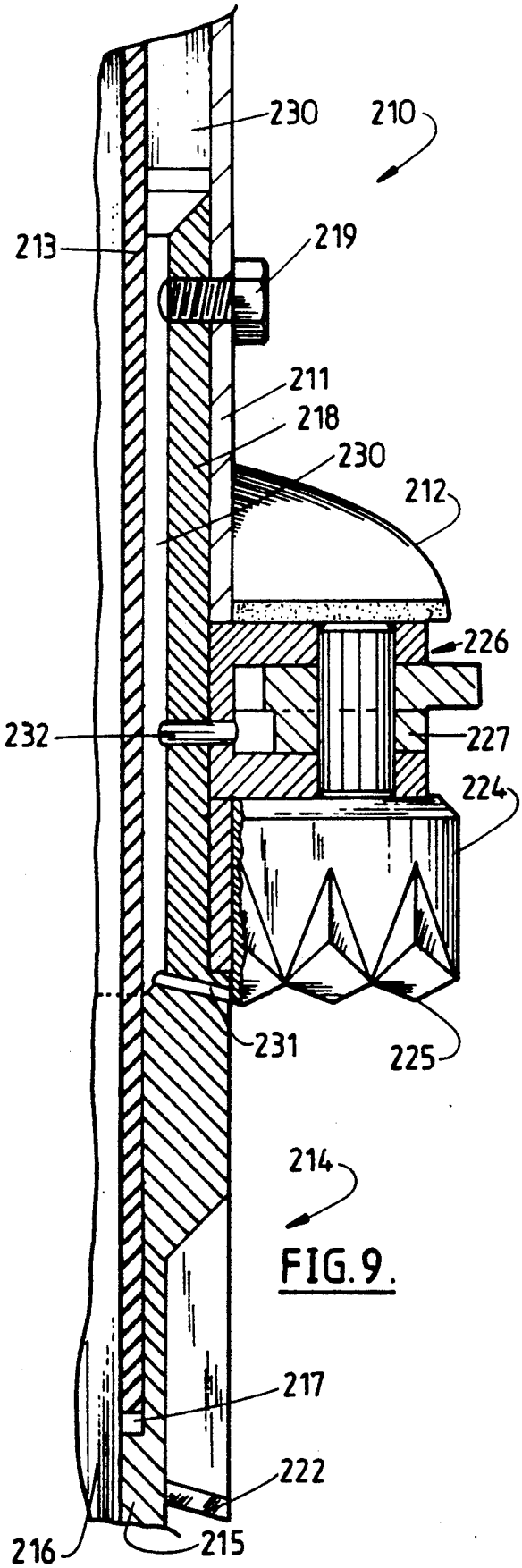
FIG. 9 is a sectional side view of the upper portion of the spear shown in enlarged scale.

Referring to FIGS. 8 and 9, the piling drill 210 has a hollow stem 211 with a helical flyte 212. A grout pipe 213 is provided co-axially down the stem 211 and is connected to a grout supply and high pressure pump, both not shown.

The spear 214 has a tubular body 215 with a co-axial grout passage 216, the upper section 217 of which is enlarged to receive the lower end of the grout pipe 213.

The upper section of the tubular body form s a hexagonal shank 218 which is received in the lower end of the drill stem 211 and secured by bolts 219.

Figure 10:
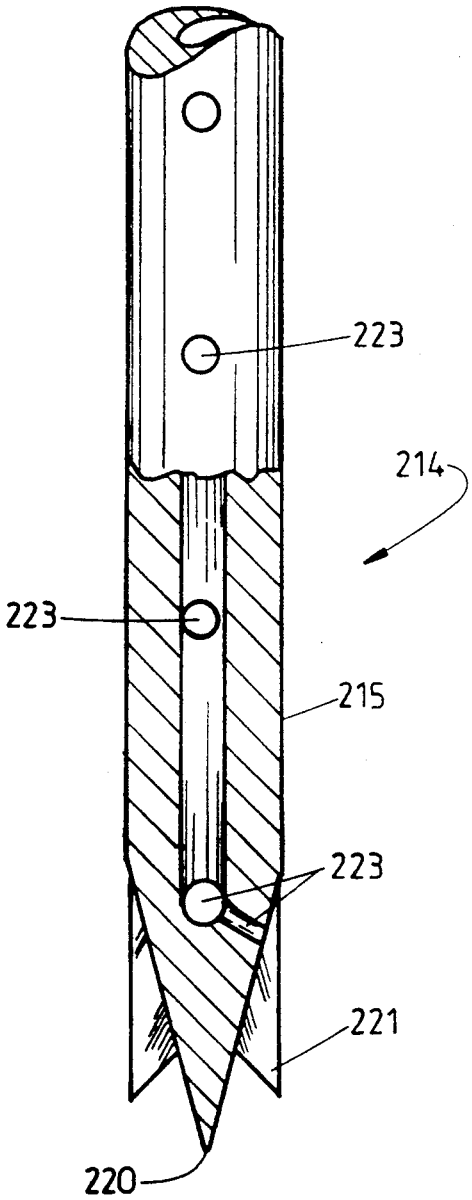
FIG. 10 is a part-sectional view of the lower portion of the spear.

The lower section of the tubular body 215 is terminated by a drilling point 220 and is provided with a pair of wing cutters 221 (see FIG. 10).

Wing cutters 222, of greater diameter, are provided just below the enlarged upper section of the body.

A plurality of grout ports 223 extend radially through the wall of the tubular body 215, the ports being spaced along the length of the spear.

As shown in FIG. 9, the drilling head 224, with teeth 225, is mounted on the shank 218 of the drilling spear, as is a belling tool 226 which has a pair of curved cutting blades 227 which, when the drilling assembly is rotated in reverse to its normal direction of rotation, are extended to cut an annular chamber or "bell" around the hole to increase the effective diameter, and thereby the load strength, of the pile cast in the hole. The belling tool is of the type shown in FIGS. 5 to 7 and as hereinbefore described.

The operation of the spear will now be described.

The spar 215, drilling head 224 and belling tool 226 are fitted to the drill 210 as shown in FIGS. 8 and 9, the drilling head and belling tool being mounted on the shank 218 of the spear 215.

The drill is rotated and the drilling point 220, wing cutters 221, 222 and the drilling head 224 progressively drill the hole as the drill assembly is advanced. When the hole reaches a level at which the soil is to be prestabilized, high pressure grout is pumped down the grout pipe 213, through the grout passage 216 and out the grout ports 223 to "frac" and fill the cracks, voids and/or fissures in the surrounding soil. The grout is a quick setting grout and starts to set as the drill assembly is again advanced a depth substantially equal to the length of the spear 215. The soil around the spear below that previously grouted, is then grouted to "frac" and fill the soil as described above.

The drill assembly is further advanced in steps until the desired depth of soil has been prestabilized around the hole.

The rotation of the drill assembly is reversed and the cutting tools 227 on the belling tool 226 swing out. As the drill assembly is rotated in the reverse direction and raised, an annular chamber or "bell" is formed around the hole, as hereinbefore described with reference to FIGS. 5 to 7.

When the "bell" is completed, grout is pumped down the outer annular passage 230 around the grout pipe 213, and out grout ports 231, 232 in the drill head 224 and belling tool 226 to fill the bell and then the hole, as the drill assembly is withdrawn, to cast the pile in-situ.

As the soil around the pile has been prestabilized, the load strength of the piles is much greater than if no stabilization was effected.

Figure 11:
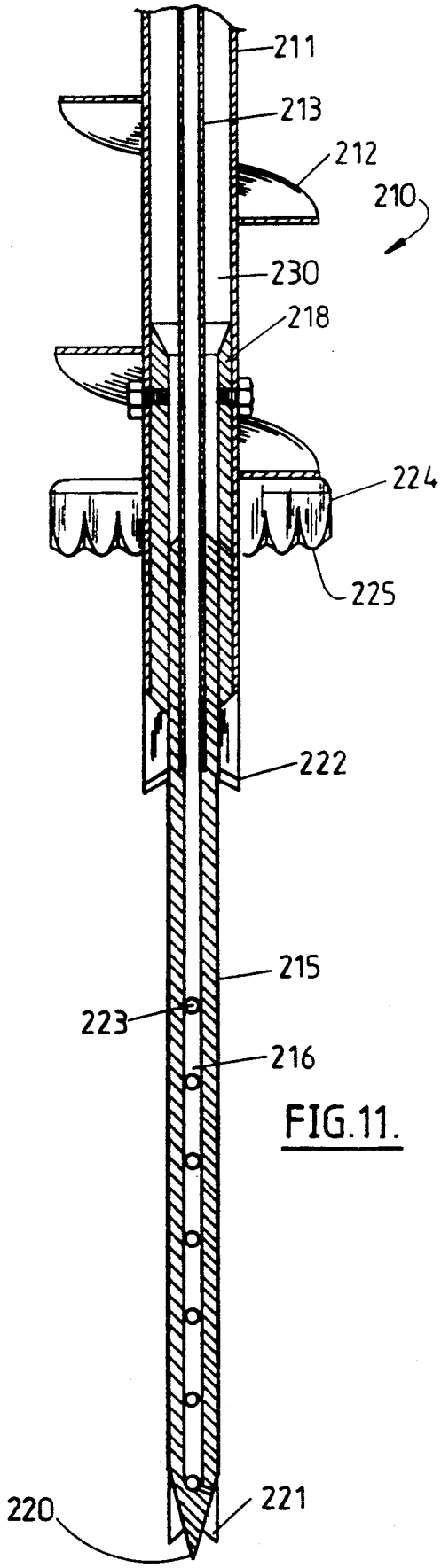
FIG. 11 is a sectional side view of the spear of a fourth embodiment fitted to a piling drill which does not have a belling tool.

Referring to FIG. 11 this shows a generally similar arrangement where the belling tool 226 is emitted.

It will be readily apparent to the skilled addressee that the present invention provides a simple, effective method of producing cast piles with large bearing areas using drills of much small diameter.

It will also be readily apparent to the skilled addressee that the present invention enables the load strength of piles to be much greater than they would otherwise have in unstabilized soil.

Various changes and modifications may be made to the embodiments described without departing from the scope of the present invention defined in the appended claims.

We claim:

1. A method of drilling a hole for an in-situ cast pile including the steps of:

drilling the hole to the required depth using a drill assembly comprising a drill for drilling holes for in-situ cast piles including a stem connectable at one end to a drilling machine and having a drilling point at the other end; a helical drilling flyte or spiral around the stem; and a plurality of cutting tools hingedly mounted on the stem at spaced intervals along the stem, each cutting tool normally occupying a retracted non-drilling position adjacent the stem when the stem is rotated in the drilling direction of the helical flyte or spiral but being movable to an extended position to cut a respective substantially annular chamber or "bell" around the hole when the stem is rotated in the reverse direction, the stem being rotated in the drilling direction, reversing the direction of the stem to cause each cutting tool to be extended;

rotating the stem to cause each cutting tool to cut a said respective annular chamber around the hole;

raising the drill assembly while rotating to increase the height of the annular chambers;

reversing the direction of rotation of the stem to return the cutting tool to its retracted position; and withdrawing the drill assembly from the hole.

2. A method as claimed in claim 1 further comprising:

pumping grout down the stem and out through an opening in the stem adjacent the drilling point while the annular chamber has been cut and while the drilling assembly is withdrawn from the hole; and allowing the grout to set.

3. A method according to claim 2 wherein:

each cutting tool acts to assist in the distribution of the grout within the chamber and the hole.

4. A drill for piles including:

a central stem;

a drilling point or tool at the lower end of the stem;

a helical flyte around the stem; and a belling tool interposed between the drilling point or tool and the lower end of the helical flyte, and comprising a housing, substantially circular in plan view, a central bore through the housing to receive the stem of a drill in rotational driving engagement, at least one cavity in the periphery of the housing, and at least two cutting tools hingedly mounted on the belling tool in the at least one cavity, said cutting tools being vertically offset and diametrically opposed, the cutting tools each normally occupying a retracted non-drilling position with its cavity when the drill is rotated in its drilling direction but being movable to an extended position to cut a respective substantially annular chamber around the hole formed by the drill when the drill is rotated in the opposite direction; and each cutting tool being curved in plan view and having a pair of hardened-faced teeth provided about their outer periphery, each cutting tool having a back tooth which cuts a greater diameter than the drilling point or tool.

5. A drill according to claim 4 wherein:

the housing is releasably secured by a shank on the drilling point or tool received in the lower end of the stem, the central bore being non-circular.

6. A drill for drilling holes for in-situ cast piles including:

a stem connectable at one end to a drilling machine and having a drilling point at the other end, a helical drilling flyte or spiral around the stem; and a plurality of cutting tool provided at spaced intervals along the stem to enable a plurality of chambers or "bells" to be formed about the hole, said cutting tools being hingedly mounted on the stem, each cutting tool normally occupying a retracted non-drilling position adjacent the stem when the step is rotated in the drilling direction of the helical flyte or spiral but being movable to an extended position to cut a respective chamber or "bell" around the hole when the stem is rotated in the reverse direction.

7. A drill according to claim 6 wherein:

each cutting tool is movable to the extended position thereof by rotating the stem in the reverse direction and is then retracted by rotating the stem in the drilling direction.

8. A drill according to claim 6 wherein:

the stem is a drilling rod, auger or casing and is hollow to allow the passage of materials into the hole and/or the chambers formed by the drill assembly.

* * * * *